United States Patent [19]

Fukuda et al.

[11] Patent Number: 5,052,449

[45] Date of Patent: Oct. 1, 1991

[54] AUTOMATIC WIRE PRESS-CONNECTING AND LAYING OUT APPARATUS FOR WIRE HARNESS

[75] Inventors: Michio Fukuda, Nishinomiya; Teiji Sakuma, Inabe; Tutomu Yoshimura, Yokkaichi, all of Japan

[73] Assignee: Sumitomo Wiring System, Ltd., Japan

[21] Appl. No.: 528,940

[22] Filed: May 25, 1990

[30] Foreign Application Priority Data

Jun. 12, 1989 [JP] Japan ..... 1-148797

[51] Int. Cl.[5] ..... H01R 43/00

[52] U.S. Cl. ..... 149/93 R; 29/755

[58] Field of Search ..... 29/564.8, 747, 748, 29/755, 850, 857; 140/92.1, 93 R

[56] References Cited

U.S. PATENT DOCUMENTS

| | | | |
|---|---|---|---|
| 3,693,228 | 9/1972 | Logan | 29/755 |
| 3,804,130 | 4/1974 | Tarbox et al. | 140/93 R |
| 3,907,007 | 9/1975 | Hobbs et al. | 140/93 R |
| 4,145,807 | 3/1979 | Beetz et al. | 29/857 |
| 4,380,117 | 4/1983 | Brandewie et al. | 29/747 |
| 4,428,114 | 1/1984 | Teagno | 29/857 |
| 4,593,452 | 6/1986 | Keahey et al. | 29/857 |

FOREIGN PATENT DOCUMENTS 50422 4/1982 European Pat. Off. .

*Primary Examiner*—Lowell A. Larson
*Attorney, Agent, or Firm*—Jordan B. Bierman

[57] ABSTRACT

An automatic wire press-connecting and laying out apparatus for a wire harness has, as its main portion, a wire press-connecting and laying out portion, comprising a wire feed portion having a wire feeding mechanism for individually feeding out wires and a wire severing mechanism for individually severing wires for feeding out wires, separate cassette lay-out boards detachably and horizontally disposed on a frame table in such a manner as to be opposite to each other via a depression and each having a group of connectors detachably arranged at predetermined positions thereon, and a head portion provided in such a manner as to vertically suspend over the cassette lay-out boards and having a transfer means for enabling the head portion to move to a relative position defined by orthogonal X and Y axis dimensions of the cassette lay-out boards, a wire drawing mechanism for individually drawing wires and a wire press-connecting mechanism comprising a plurality of wire press-connecting portions arranged in parallel. These wire drawing and wire press-connecting mechanisms are provided in such a manner as to face downwardly. A wire dimension adjusting mechanism for adjusting the dimension of individual wires is provided either on the wire feeding mechanism or on the wire drawing mechanism, and the head portion clamps wires protruding from the distal end of the wire feed portion and sequentially distributes the clamped wires to the connectors so as to be press-connected thereto. The wires are individually severed after the dimension of the individual wires has been adjusted, and the wires are laid out in a required configuration with the intermediate portions thereof being allowed to suspend into the depression so as to be received therein.

3 Claims, 11 Drawing Sheets

AUTOMATIC WIRE PRESS-CONNECTING AND LAYING OUT APPARATUS FOR WIRE HARNESS

BACKGROUND OF THE INVENTION

1. Field of the Invention

The present invention relates to an automatic wire press-connecting and laying out apparatus for use in making a wire harness in which a group of required wires are press-connected and laid out in a required configuration.

2. Statement of the Prior Art

The official gazette of U.S. Pat. No. 3,930,524 discloses a typical example of conventional automatic wire press-connecting and laying out apparatus for a wire harness and a method for manufacturing the same, and the official gazette of Japanese Patent Laid-Open No. 95016/1982 discloses a typical example of automatic apparatus for forming wires having solderless terminals and a method for manufacturing the same.

In the automatic wire press-connecting and laying out apparatus disclosed in the former official gazette of the U.S. patent wire end holders are arranged at predetermined positions on a lay-out board in the actual dimensions of a wire harness to be made, and a wire dispensing head adapted to move in two dimensions along X and Y axes is provided above the lay-out board. This wire dispensing head clamps a wire fed from a wire feed portion and distributes it to predetermined wire end holders on the lay-out board, where the ends of the wire are set to be retained, and the wire is then cut, the wire being thereby laid out in a predetermined configuration. This operation is repeated until a required configuration for the wire harness being made is completed. Afterwards, individual wires so set in wire end holders are press-connected to terminals in a sequential manner. Thus, a group of wires required to make a wire harness are automatically press-connected and laid out in a predetermined configuration.

In contrast, in the automatic apparatus for forming wires having solderless terminals disclosed in the latter official gazette of the Japanese patent the main part of the apparatus comprises a connector feed path for forward feeding a pair of connectors, a plurality of groups of work heads disposed along the length of the connector feed path at suitable intervals, and wire feed portions provided for each of the plurality of work head groups. In this construction, at each position along the connector feed path where a group of work heads are provided a wire to be fitted on a pair of connectors being fed along the feed path is cut to a predetermined dimension, and is press-connected to the pair of connectors at the ends thereof. Thus, at the end of the forward travel along the feed path, the pair of connectors are fitted with a group of required wires having solderless terminals press-connected thereto.

Of these prior art automatic wire press-connecting and laying out apparatuses, the former apparatus has the following drawbacks due to the basic construction thereof in which a lay-out board in the actual dimension of a wire harness to be made is employed and in which wires are press-connected and laid out one by one after they have been cut to predetermined dimensions.

(1) The total travelling distance of the wire dispensing head becomes substantially equal to the total length of wires used. Due to this, the productivity of wire harnesses comprising a number of groups of long wires becomes low, and hence the apparatus is not suitable for mass-production systems.

(2) A lay-out board in actual dimensions is used, and the maximum total length of wires laid out becomes about three meters before such a lay-out board is completed. Due to this, an enormous apparatus is needed, and hence excessively wide space is required to install such as apparatus. Moreover, the number of travelling strokes of the wire dispensing head becomes equal to the number of wires laid out. These facts involves the multiplication of low productivity.

(3) The apparatus disclosed only functions to dispense wires on wire end holders arranged on the lay-out board so as to set the same thereon and many post-stages including that of press-connecting wires so dispensed are left unfulfilled.

The latter automatic apparatus for forming wires having solderless terminals has the following drawbacks due to the construction thereof in which wires are press-connected to a pair of connectors one by one by work heads arranged linearly.

(1) The press-connecting of wires is allowed only between a pair of connectors, and in a case where a wire harness has three or more connectors to which wires have to be press-connected, it has to be disassembled to accomplish this after the press-connecting of wires between any two of those connectors has been completed. Due to this, the types of wire harnesses to be formed with this apparatus are limited.

(2) Only wires having solderless terminals can be formed, and laying out of wires for a wire harness cannot be accomplished. Due to this, there remain a number of post-stages to be accomplished before the formation of a wire harness is completed.

(3) Groups of work heads are linearly arranged, and wire feed portions are required for each group of work heads. Due to this, the apparatus has to be made larger and complex, and hence wide space is needed for the installation thereof. Thus, the apparatus lacks the suitability for an automatic forming apparatus.

SUMMARY OF THE INVENTION

An object of the present invention is to provide a novel automatic wire press-connecting and laying out apparatus for a wire harness that can eliminate the above-mentioned drawbacks inherent in the prior art.

This technical subject is fulfilled by an automatic wire press-connecting and laying out apparatus according to first and second embodiments of the present invention. The main portion of the first embodiment comprises:

a wire feed portion for feeding out a group of wires that has a mechanism for individually feeding out wires and a mechanism for individually severing wires:

separate cassette lay-out boards detachably and horizontally disposed on a frame table in such a manner as to be opposite to each other via a depression and each having a group of connectors detachably disposed at predetermined positions thereon: and a head portion disposed so as to vertically suspend over the cassette lay-out boards and having a transfer means for enabling transfer to a relative position defined by two dimensions along X and Y axes, and a drawing mechanism for individually drawing wires and a wire press-connecting mechanism comprising a plurality of wire press-connecting portions disposed in parallel, these two mechanisms being made to face downwardly.

A mechanism for individually adjusting the dimension of wires is provided either on the mechanism for individually feeding out wires or on the mechanism for individually drawing wires. In this construction, the ends of a group of wires projecting from the wire feed portion are clamped by the head portion, which distributes the wires to connectors disposed at M end (corresponding to the leading ends of the wires) in a sequential manner with the wires being individually severed to a predetermined dimension. The wires so severed are press-connected to the connectors at M end with the intermediate portions thereof being allowed to suspend into the depression so as to be received therein. Subsequently, the drawing mechanism draws out the intermediate portions of the respective wires from the depression until the other ends of the wires come to the head portion with the intermediate portions thereof again being allowed to suspend in the depression so as to be received therein, and then the head portion transfers and distributes the wires to connectors at N end (corresponding to the rear ends of the wires), where the wires are press-connected to the connectors at the other end thereof thereby making it possible to lay out a group of wires in predetermined configuration with both ends thereof being press-connected to the connectors.

The main portion of the automatic wire press-connecting and laying out apparatus according to the second embodiment of the present invention comprises:

a wire feed portion for feeding out a group of wires that has a mechanism not only for individually adjusting the dimension of wires but also for individually feeding out wires and a mechanism for individually severing wires:

separate cassette lay-out boards detachably and horizontally disposed on a frame table in such a manner as to be opposite to each other via a depression, each having a group of connectors detachably disposed at predetermined positions thereon, and having a transfer means for enabling the transfer thereof in a dimension along the X axis:

a head portion disposed so as to vertically suspend over the cassette lay-out boards and having a transfer means for enabling transfer thereof in a dimension along the Y axis and a drawing mechanism for individually drawing wires at the lower portion thereof: and wire press-connecting presses disposed on the frame table at positions adjacent to the outer edges of the cassette lay-out boards disposed opposite to each other.

The connectors are detachably mounted on a connector fixing jig having a wire holder for temporarily holding a wire.

In this construction, the ends of a group of wires projecting from the wire feed portion are clamped by the head portion which distributes the wires to the wire holders of the connectors disposed at M end (corresponding to the leading ends of the wires) in a sequential manner with the wires being individually severed to a predetermined dimension. The wires so severed are press-connected to the connectors at M end by means of the wire press-connecting press with the intermediate portions thereof being allowed to suspend into the depression so as to be received therein. Subsequently, the drawing mechanism draws out the intermediate portions of the respective wires from the depression until the other ends of the wires come to the head portion with the intermediate portions thereof again being allowed to suspend in the depression so as to be received therein, and then the head portion transfers and distributes the wires to the wire holders of the connectors at N end (corresponding to the rear ends of the wires) in a sequential manner, where the wires are press-connected to the connectors at the other end thereof by means of the wire press-connecting press, thereby making it possible to lay out a group of wires in predetermined configuration with both ends thereof being press-connected to the connectors.

In the automatic wire press-connecting and laying out apparatus constructed as described above according to the present invention, a plurality of wires are distributed to the groups of connectors arranged on the separate cassette lay-out boards disposed opposite to each other via the depression every travel of the head portion, and the wires so laid out are then press-connected to the associated connectors with the intermediate portions thereof being allowed to suspend into the depression so as to be received therein. Due to this, the total travelling distance of the head portion can be remarkably reduced to "one-twentieth or thirtieth" of the total length of the wires used, and the number of travelling strokes of the head portion can also be reduced to "one half or third" of the number of wires used, the efficiency of wire press-connecting and laying out operations for the formation of a wire harness being thereby improved remarkably. In addition, the press-connecting and laying out of wires are performed on the cassette, lay-out boards disposed close to each other. This serves to make the apparatus smaller in size, and the necessity for enormous space for the laying out of wires can be obviated. Furthermore, the cassette lay-out boards on which wires have been properly press-connected and laid out only have to be transferred to a wire harness forming conveyor or the like, where the cassette lay-out boards are properly spaced at a predetermined span of wires and final work such as completing the configurations of the laid out wires mounting accessory parts and so forth can be carried out, the efficiency of the total wire harness forming operation being thereby improved remarkably.

DESCRIPTION OF THE DRAWINGS

FIG. 1 shows the automatic wire press-connecting and laying out apparatus according to the first embodiment of the present invention, wherein

FIG. 2 shows the wire feed portion of the apparatus shown in FIG. 1(A), wherein

FIG. 3 shows the head portion of the embodiment shown in FIG. 1, wherein

FIG. 4 shows the main portion of the head portion of the embodiment shown in FIG. 1, wherein

FIG. 5 shows the connector fixing, jig of the embodiment shown in FIG. 1, wherein

FIG. 8 shows the automatic wire press-connecting and laying out apparatus according to the second, embodiment of the present invention, wherein

DETAILED DESCRIPTION OF THE PREFERRED EMBODIMENTS

Figure 1A:
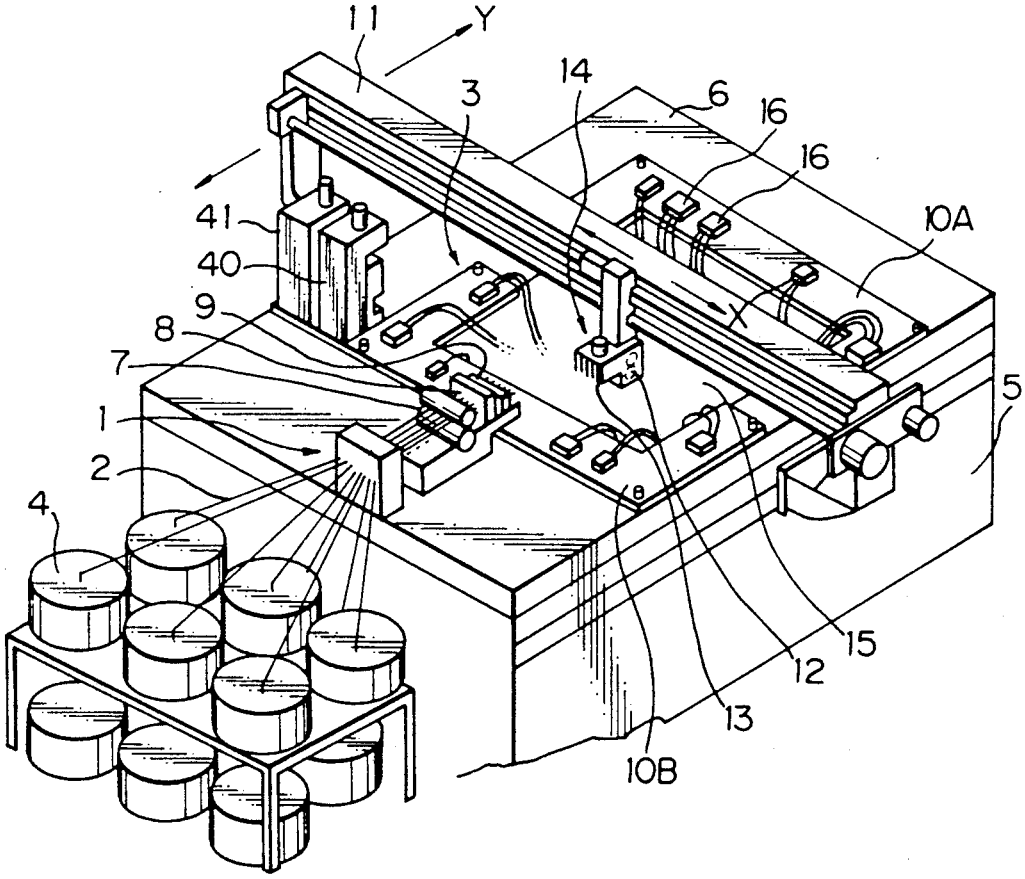
FIG. 1(A) is a perspective view showing the whole of the apparatus.

Referring to the accompanying drawings, embodiments of the present invention will now be described in detail.

Referring to FIGS. 1 to 6, the automatic wire press-connecting and laying out apparatus according to the first embodiment of the present invention will be described. As shown in FIG. 1, the main portion of the apparatus comprises a wire feed portion 1 for adjusting the dimension of a group of wires 2 and feeding out the same and a wire press-connecting and laying out portion 3 for press-connecting the group of wires 2 so fed to connectors 16. The wire feed portion 1 in turn comprises a wire supply 4 from which various types of wires 2 are drawn out to be supplied in a sequential manner, a mechanism 7 for adjusting the dimension of wires and feeding out the same (hereinafter referred to as "wire dimension adjusting and feeding out mechanism) and a severing mechanism 9. These two mechanisms are provided as a unit on a table 6 of a frame 5.

The wire press-connecting and laying out portion 3 comprises a pair of separate cassette lay-out boards 10A, 10B disposed horizontally on the table 6 on the frame 5 in such a manner as to be opposite to each other via a depression 15 and each having connectors 16 arranged at predetermined positions thereon, and a head portion 14 vertically suspending from a travelling portal frame 11 provided on the frame 5 in such a manner as to travel over the cassette layout boards 10A, 10B in orthogonal dimensions along the X and Y axes, and having a wire drawing mechanism 12 for drawing wires 2 and a wire press-connecting mechanism 13 comprising a plurality of press-connecting portions.

Figure 1B:
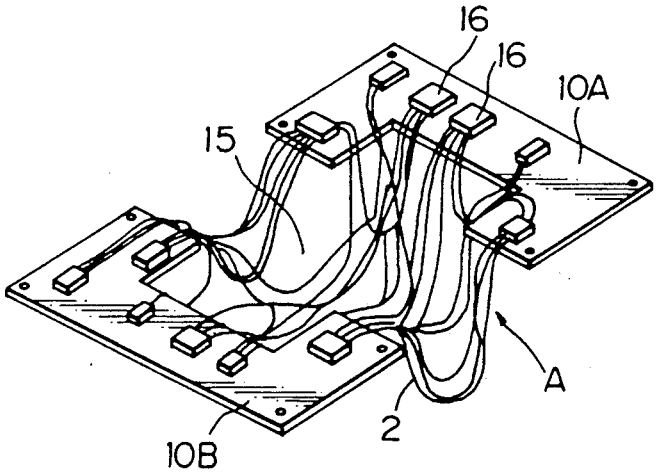
FIG. 1(B) is a perspective view showing cassette lay-out boards on which press-connecting and laying out of wires have been completed.

The head portion 14 clamps the leading ends of a group of wires that protrude from the distal end of the wire feed portion 1 in an laterally parallel fashion and moves to distribute them to the connectors 16 arranged at predetermined positions in a sequential manner, and the intermediate portions of the wires 2 are, as shown in FIGS. 1(B), (D), allowed to suspend into the depression 15 so as to be received therein during the movement of the head portion 14. Thus, the wires 2 are laid out in a predetermined configuration for a wire harness being made, and the wires 2 so laid out are press-connected to the connectors 16 at the ends thereof, thereby making it possible to form a wire harness forming unit A in which the wires having solderless connectors are laid out in a required configuration.

To be specific, as shown in FIG. 2, the wire feed portion 1 has downstream of the wire supply 4 in which wires in various sizes are stored in the form of reels or in buckets the wire dimension adjusting and feeding out mechanism 7 for adjusting the dimension of wires 2 aligned in parallel and individually feeding out the same and the severing mechanism 9 for individually severing the wires 2 the dimension of which has been adjusted accordingly. The leading ends of the wires 2 drawn out of the wire supply 4 are caused to protrude from the severing mechanism 9 for transfer to the connectors, and when the leading ends of the wires 2 are fed into the head portion 14, the wire dimension adjusting and feeding out mechanism 7 starts to individually feed out the wires 2 while individually adjusting the dimension thereof, subsequent to which the wires 2 so fed out are individually severed to a predetermined dimension by means of the severing mechanism 9. Afterwards, the wires so severed are fed to the wire press-connecting and laying out portion 3.

Figure 2A:
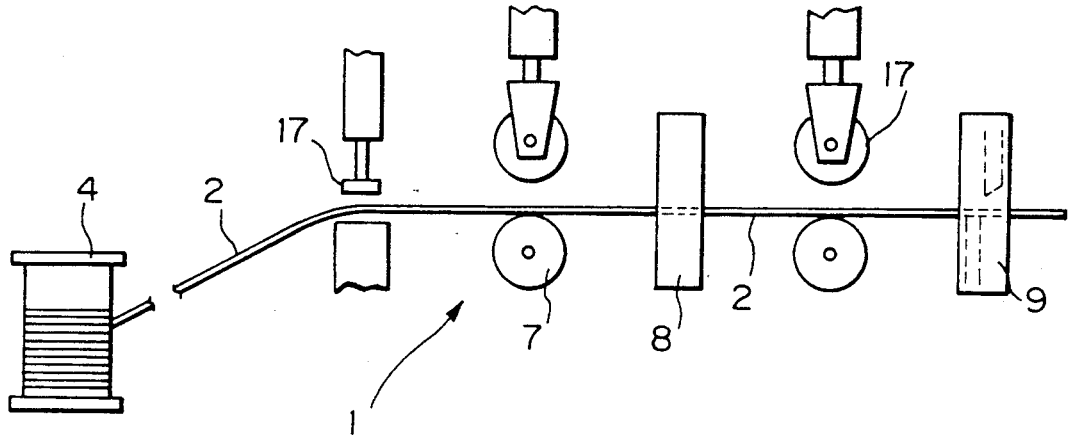
FIG. 2(A) is a drawing showing the concept of the construction of the wire feed portion.
Figure 2A:
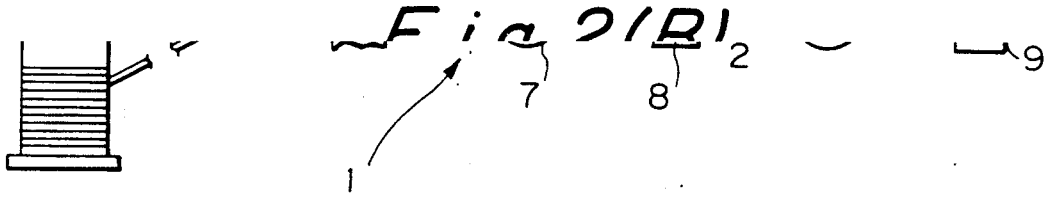
Figure 2B:
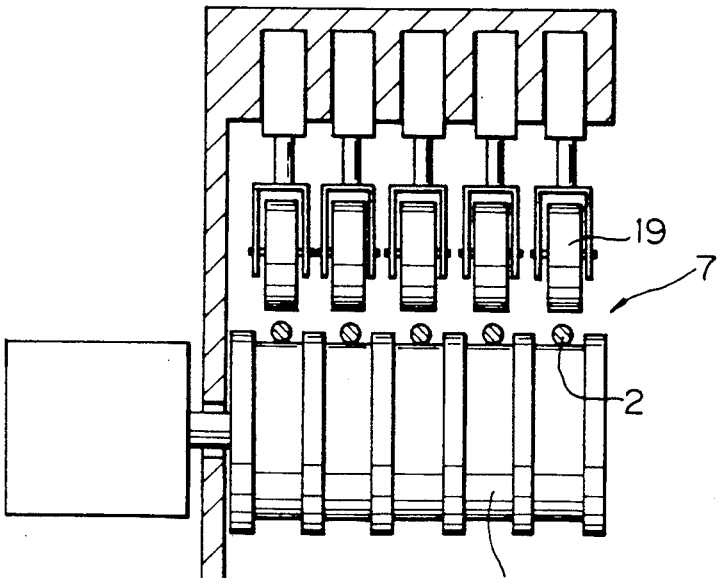
FIG. 2(B) is a front view of the mechanism for adjusting the dimension of wires and feeding out wires.

The wire dimension adjusting and feeding out mechanism 7 employed in this embodiment comprises, as shown in FIG. 2(B), a rotatable laterally elongate main roller 18 and sub-rollers 19 disposed above the main roller 18 so as to individually clamp and/or unclamp the wires 2 in cooperation with the former and in this construction when the wires 2 are individually clamped between the main and respective sub-rollers, the wires 2 are individually fed out while the dimension of the wires 2 are being individually adjusted. The severing mechanism 9 has severing blades for individual wires and is mechanically interlocked with the wire dimension adjusting and feeding out mechanism 7 so as to sever the wires 2 when the dimension thereof has been adjusted.

In FIG. 2(A), reference numeral 8 denotes a marking portion for applying a numeral or identification color to wires to be fed out with the dimension thereof being adjusted if such is required, and reference numeral 17 denotes a wire clamp for applying a low tension to wires 2 fed through the wire dimension adjusting and feeding out mechanism 7 with a view to improving the dimension adjusting accuracy of the same mechanism.

Figure 5A:
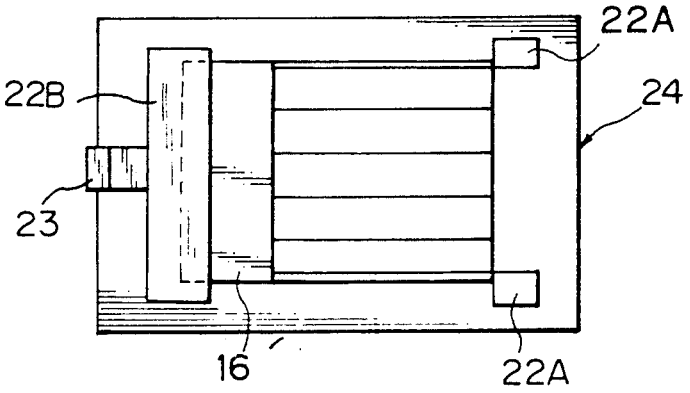
FIG. 5(A) is a plan view of the jig and FIG. 5(B) is a front view of the same.
Figure 5B:
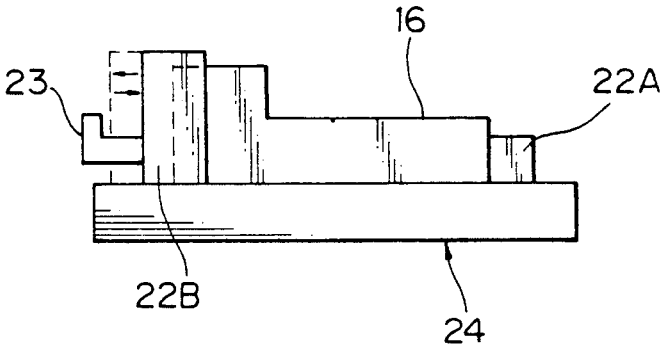

The cassette lay-out boards 10A, 10B of the wire press-connecting and laying out portion 3 are detachably fixed onto the table 6 via the depression 15 that is deep enough to accommodate the longest wire required for a wire harness to be made when it is allowed to suspend thereinto, and the group of connectors 16 to which M ends (the leading ends) of the wires 2 are press-connected are arranged in a required configuration for a wire harness being made mainly on the lay-out board 10A, while the group of connectors 16 to which N ends (the rear ends) of the wires 2 are press-connected are arranged in a required configuration for a wire harness being made mainly on the lay-out board 10B, These groups of connectors are, as shown in FIG. 5, securely mounted on connector fixing jigs 24 having a one-touch attaching and/or detaching construction in which when an operation piece 23 is pressed down, a locking pawl 22*b* is biased forward by the action of a spring, thereby holding the connector 16 so as to be fix in position, while when the locking pawl 22*b* is allowed to withdraw, the connector 16 is then released.

Figure 3A:
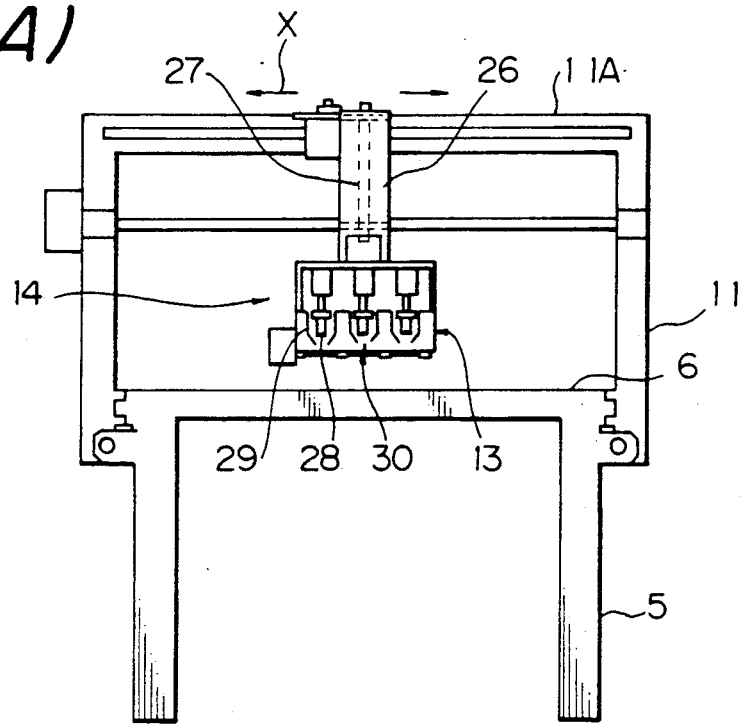
FIG. 3(A) is a front view of the head portion.
Figure 3B:
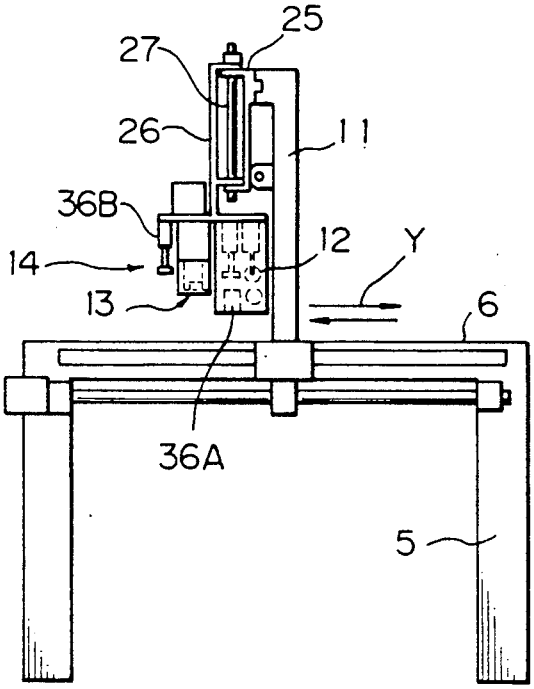
FIG. 3(B) is a side view of the same.

As shown in FIGS. 3 and 4, the head portion 14 of the wire press-connecting and laying out portion 3 is provided in such a manner as to vertically suspend from a vertical suspending frame 26 mounted on a travelling table 25 adapted to travel in the X axis dimension of the cassette lay-out boards 10A, 10B along an upper beam 11A of the portal frame 11 that is adapted to travel in the Y axis dimension of the cassette lay-out boards 10A, 10B along the sides of the frame 5. In addition, this vertical suspending frame 26 has a rotation mechanism for allowing itself to rotate through 180° about a vertical suspending shaft 27. Thus, the head portion 14 is constructed such that it can freely travel in the X and Y axes over the cassette laying boards 10A, 10B, while it can also freely rotate about the axis of the vertical suspending shaft.

Furthermore, the head portion 14 has the wire press-connecting mechanism 13 and wire drawing mechanism 12, and these mechanisms will be described in detail below. As shown in FIG. 4(B), the wire press-connecting mechanism 13 comprises a wire press-connecting portion 30 comprising in turn a plurality (three in the drawing) of receiving cases 29 arranged in parallel. This receiving case 29 comprises a pair of nail pieces and receives therein a known wire press-connecting blade 28 in such a manner that the blade 28 faces downwardly. In addition, the receiving case 29 is provided with a slit-like resilient opening 31 at the bottom end thereof. A press-connecting blade selection member 34 is provided in a housing 32 above the wire press-connecting portion 30 comprising a plurality of receiving houses 29 arranged in parallel, and an actuator portion 33 is provided above the press-connecting blade selection member 34 to vertically move the same member. Thus, the wire press-connecting mechanism 13 incorporates a press-connecting blade selection mechanism in which of the press-connecting blades 28 installed only selected one or ones is caused to operate.

Figure 4A:
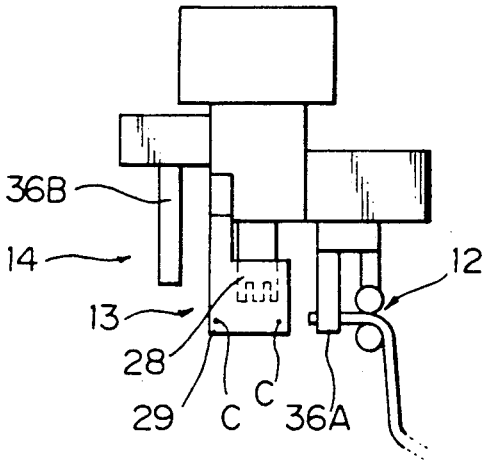
FIG. 4(A) is a side view of the main portion.
Figure 4B:
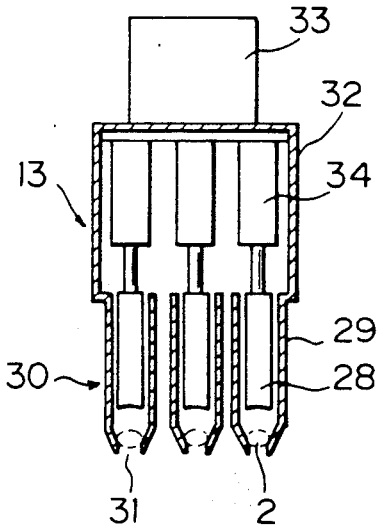
FIG. 4(B) is a front view of the wire press-connecting mechanism of the main portion.
Figure 4C:
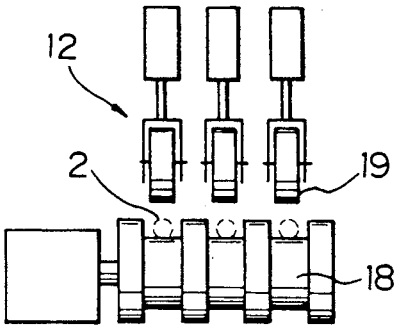
FIG. 4(C) is a front-view of the wire drawing mechanism of the same, FIGS. 4(D), (E) are front views of wire pressing mechanisms of the main portion.
Figure 4D:
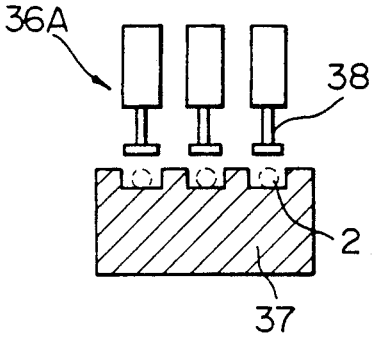
Figure 4E:
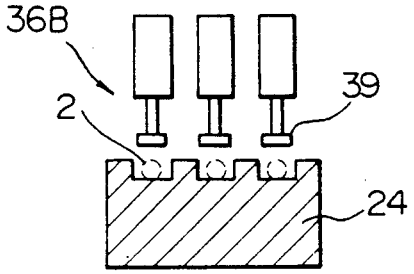
Figure 4F:
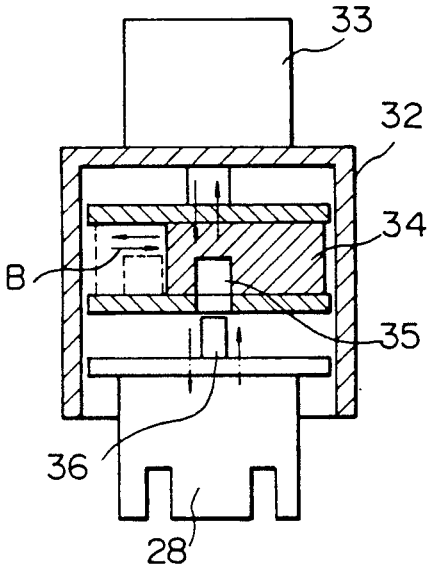
FIG. 4(F) is a side view of a wire press-connecting selection means.

The press-connecting blade selection member 34 is, as shown in FIG. 4(F), caused to selectively operate in the direction as shown by reference arrow B in the housing 32, and a losing notch 35 is formed in the press-connecting blade selection member 34 in such a manner as to extend from the vertically intermediate portion to the bottom portion thereof. The press-connecting blades 28 needing to operate are forcibly pressed down so as to operate by the actuator portion 33 via the press-connecting blade selection member 34, while an operation pin 36 provided on the top end of the press-connecting blade 28 that does not need to operate is caused to loosely fit in the losing notch 35 formed in the press-connecting blade selection member 34, the downward force that would be otherwise applied to the relevant press-connecting blade 28 by the actuator portion 33 being thereby lost, and the press-connecting blade 28 is thus prevented from being lowered. A sensor C is provided in each receiving case 29 so as to detect whether or not the wire 2 is received therein, as well as the end of the wire 2 so received.

When the wire 2 is inserted between the bottom end of the press-connecting blade 28 and the opening 31 to be held in position in the receiving case 29 with the press-connecting blade 28 needing to operate being lowered, the opening 31 is caused resiliently open so as to allow the wire 2 and press-connecting blade 28 to pass therethrough further downwardly and the wire 2 is press-connected to the connector 16 positioned below the opening 31. Following this the press-connecting blade 28 that has been lowered to complete the press-connecting operation is then restored to its original position by the resilient action of a spring.

The wire drawing mechanism 12 comprises, as shown in FIGS. 4(A), (C), the single laterally elongate main roller 18 and the sub-rollers 19 for individually clamping and/or unclamping the wires 2 on the main roller 18 in cooperation of the main roller 18. These sub-rollers 19 are adapted to individually clamp the wires 2 needing to be fed out so as to feed out the same toward the side of the press-connecting mechanism 13.

Furthermore, in the head portion 14, wire pressing mechanisms 36A and 36B are provided, respectively between the wire drawing mechanism 12 and press-connecting mechanism 13, and behind the press-connecting mechanism 13. The wire pressing mechanism 36A comprises, as shown in FIG. 4(D), a wire holding member 37 and pressing members 38 provided above the wire holding member 37 for individually clamping the wires 2, and this mechanism functions to individually clamp the wires 2 fed out of the wire feed portion 1 and hold them while the head portion 14 travels over the cassette lay-out boards 10A, 10B. The other wire pressing mechanism 36B is, as shown in FIG. 4(E), intended for function as an auxiliary pressing mechanism for individually clamping the wires 2 at the upper edge of the connector fixing jigs 24 via pressing pieces 39 with a view to allowing the head portion 14 to perform a wire press-connecting operation at N end in a smooth fashion.

In this embodiment as shown in FIG. 1(A), a known peeling machine 40 for press-mounting operations and a terminal press-mounting machine 41 are provided in a corner of the table 6 and terminals may be press-mounted on wires, if such is required.

The wire press-connecting and laying out apparatus the main portion of which comprises the above-described wire feed portion 1 and wire press-connecting and laying out portion 3 incorporates automatic control circuits each programmed to carry out a series of operations required to form a specific wire harness. In other words, an automatic control circuit storing a particular program designed to form a wire harness of a particular construction controls a series of required operations, wires 2 needed are selectively fed out to the head portion 14 while the dimension thereof being adjusted, the head portion 14 then selects connectors to which the wires are press-connected and distributes them to the connectors so selected, and the wires are press-connected to the connectors. In addition, the automatic control circuits also control operations of the individual constituent elements, cooperations therebetween, operations selectively performed by particular constituent elements and so forth during a series of required operations.

Figure 6A:
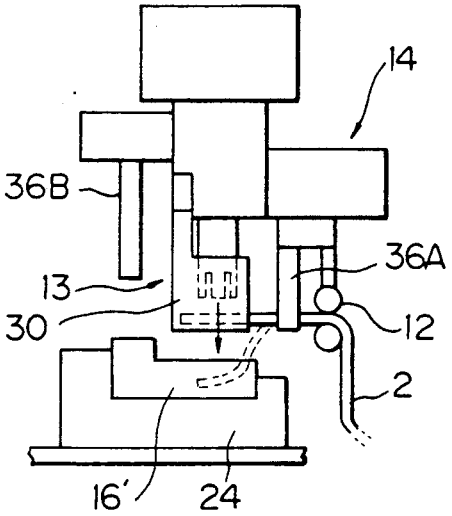
FIGS. 6(A), (B), (C) and (D) are side views showing states in which the head portion is in operation, respectively.

A wire harness is automatically formed by the action of the automatic control circuits as will be described below. When the leading ends of wires 2 are caused to protrude from the distal end of the wire feed portion 1 for the distribution to connectors, the wire drawing mechanisms 12 of the head portion 14 selectively draws wires 2 needed, and the wires 2 so selected are, as shown in FIG. 4(A), clamped by means of the wire clamping mechanism 36A, and the leading ends of the wires are thus transferred to the head portion 14. When the head portion 14 starts to move, the wires 2 are fed out by means of the wire dimension adjusting and feeding out mechanism 7. When the head portion 14 arrives at a position above a predetermined connector 16' on the cassette lay-out board 10A on which a wire press-connecting operation is to be first carried out the wire drawing mechanism 12 is, as shown in FIG. 6(A), caused to operate so as to insert the leading end of the selected wire 2 into the wire press-connecting portion 30, subsequent to which the press-connecting blade 28 is selectively lowered so that only the wire needing to be press-connected are press-connected to the connector 16' at M end thereof. Following this, the head portion 14 then moves to another connector 16, to which the remaining clamped wire is press-connected at M end thereof in the same manner.

When the wires clamped by the head portion 14 have been press-connected to the predetermined connectors at M ends thereof, the head portion 14 lays out the clamped wires in required configurations while feeding them out rearwardly with the intermediate portions thereof being allowed to suspend into the depression 15 so as to be received therein, and the head portion 14 then moves toward the cassette layout board 10B. The wires clamped by the head portion 14 are fed out by means of the wire dimension adjusting and feeding out mechanism 7 while the dimension thereof being adjusted by the same mechanism 7, and when the wires are fed out to a predetermined dimension, they are individually severed by the severing mechanism 9.

Figure 6B:
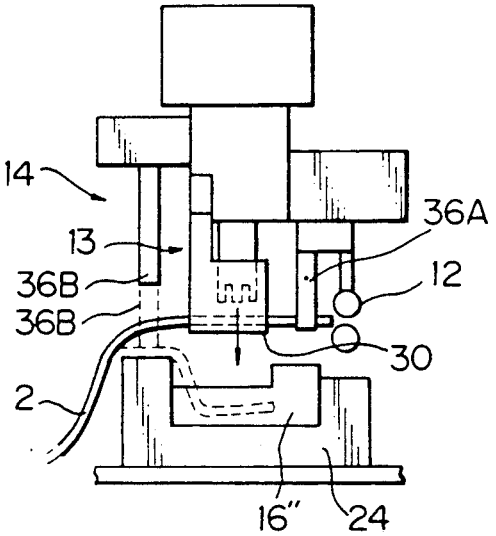

As shown in FIG. 6(B), the head portion 14 moves and stops over a predetermined connector 16'' on which a wire press-connecting operation is to be first carried out with N ends of the wires being held thereon by means of the wire pressing mechanism 36A, and the wire pressing mechanism 37B is actuated so as to selectively fix only the wire to be press-connected to the connector 16'' to the upper end of the connector fixing jig 24 for the stabilization of the posture thereof, subsequent to which as soon as the wire pressing mechanism 36A is released, the wire press-connecting portion 30 is caused to selectively press-connect only the wire needed to the connector 16'' at N end thereof. The head portion 14 then moves to another connector to which the remaining clamped wire is to be press-connected at N end thereof, and the relevant wire is then press-connected to the connector accordingly.

The above-described operations are repeated in a sequential manner, thereby making it possible to automatically form a wire harness forming unit A having press-connected connectors that satisfies a wire laying out requirement for a wire harness being made with the connectors 10 being secured to the cassette lay-out boards 10A, 10B.

Figure 1C:
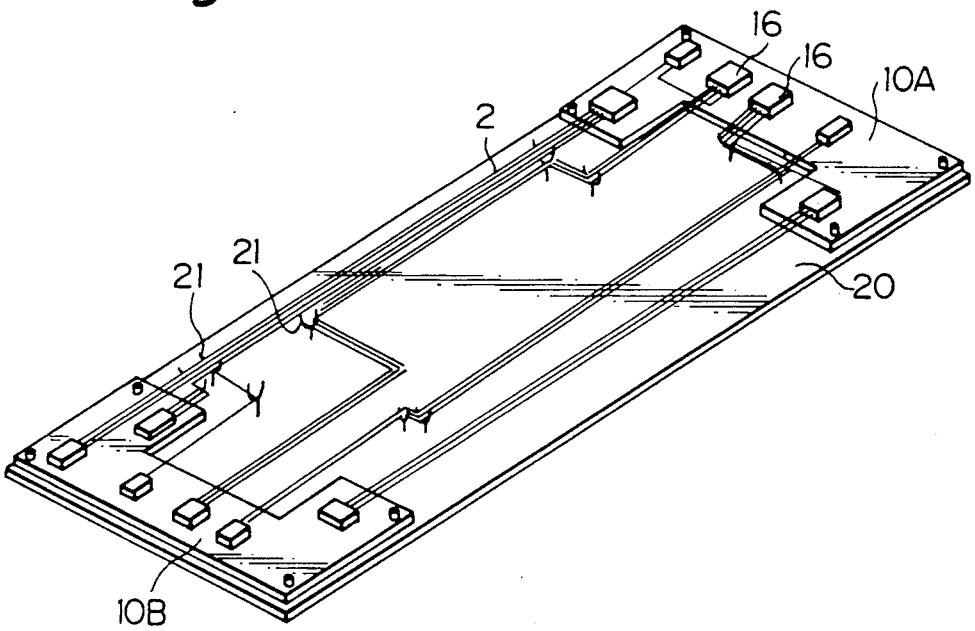
FIG. 1(C) is a perspective view showing a state in which a wire harness is formed.
Figure 1D:
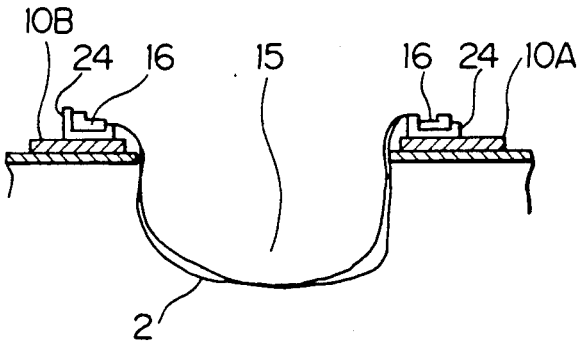
FIG. 1(D) is a sectional view of the main portion-of the apparatus shown in FIG. 1(A)
Figure 1E:
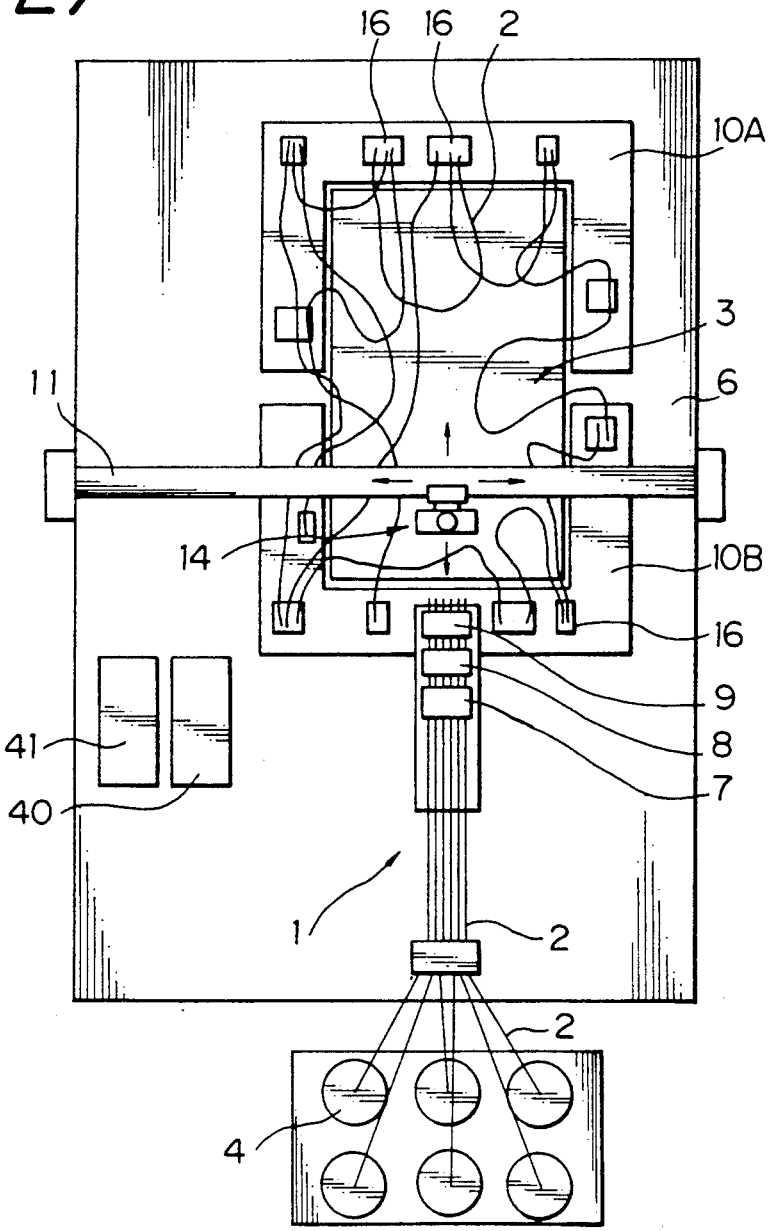
FIG. 1(E) is a plan view of the apparatus shown in FIG. 1(A)

The wire harness forming unit A completed as described above is then placed on a forming conveyor 20, and the cassette lay-out boards 10A, 10B are spaced at the normal span thereof, the wire harness forming unit A being thereby laid out properly on the conveyor as shown in FIG. 1(C). The bundle of wires are then set on lay-out branching jigs 21 provided on the conveyor 20 so that a required lay-out configuration for a wire harness being made is completed, and bundling taping, grommets and other accessory parts are mounted on the wires. Finally the connectors 16 are dismounted from the cassette lay-out boards 10A, 10B thus making it possible to form a desired wire harness.

Figure 6C:
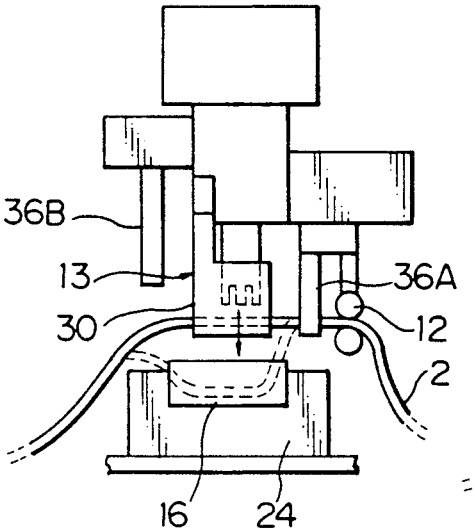
Figure 6D:
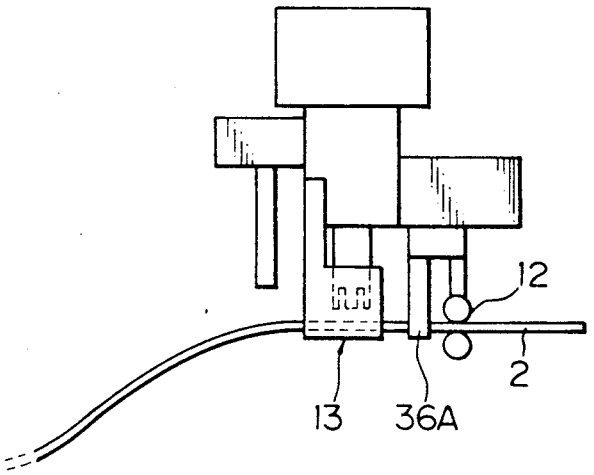

In the above press-connecting operations, in a case where a lay-out configuration requires a connector 16 to be press-connected to an intermediate position along the length of the wire 2 the head portion 14 moves to a predetermined intermediate connector 16 after the press-connecting of wires has been completed at M ends thereof as shown in FIG. 6(C), the relevant intermediate portion of the wire is press-connected to the intermediate connector 16 by the wire press-connecting portion 30. In addition, in a case where the wire has to be press-connected to a connector 16 diagonally disposed relative to the X and Y axes, the head portion 14 is then caused to rotate so as to adjust the direction of the wire, and the wire is properly press-connected to the predetermined connector 16. Furthermore, in a case where a solderless terminal has to be mounted on the wire, the head portion 14 moves to the peeling machine 40 and terminal-mounting machine 41, and the terminal is then press-mounted to the end of the wire held by the wire pressing mechanism 36A and protruding from the head portion 14. The solderless terminal so press-mounted on the wire is inserted into a predetermined connector during the wire harness forming operation that is carried out on the forming conveyor 20.

In the first embodiment as described above, the wires are transferred from the wire feed portion 1 to the head portion 14 having the wire press-connecting mechanism comprising a plurality of wire press-connecting portions, and the head portion 14 holding the wires sequentially moves to the connectors provided on the cassette lay-out boards 10A, 10B that are disposed within a short distance in such a manner as to be opposite to each other via the depression 15, and the wires are laid out in a predetermined configuration with the intermediate portions of the wires being allowed to suspend into the depression 15 so as to be received therein. Afterwards the wires so distributed are press-connected to the connectors in a sequential fashion, thereby making it possible to automatically form a wire harness forming unit A in which the wires having the press-connected connectors are laid out in a required configuration for a wire harness being made. With this construction of the present invention the whole travelling distance and the number of travelling strokes of the head portion 14 can remarkably be reduced respectively. Moreover it is possible to efficiently select circulation paths between the groups of connectors, and due to this the efficiency of the press-connecting and laying out of wires can remarkably be improved. Furthermore the cassette lay-out boards 10A, 10B are disposed with in a short distance in such a manner as to be opposite to each other via the depression 15, and this construction requires less space to form a wire harness compared with the prior art lay-out boards which are formed into an actual dimensions of a wire harness to be made, thereby making it possible to make the size of the apparatus smaller.

Modifications that can be made to the first embodiment of the present invention will now be described. Although not shown in the drawings the dimension adjusting mechanism of the wire dimension adjusting and feeding out mechanism 7 of the wire feed portion 1 is transferred to the wire drawing mechanism 12 of the head portion 14 so that the dimension of the wires may be adjusted while they are being drawn during the transfer of the head portion 14, and the severing mechanism 9 of the wire feed portion 1 may be mechanically interlocked with the adjustment of the dimension of the wires performed in the head portion 14. In addition, the direction in which the connectors are disposed on the cassette lay-out boards 10A, 10B may be restricted in such a manner that the direction in which the wires are press-connected to the connectors 16 becomes parallel to the Y axis along which the head portion 14 is transferred, and the rotation mechanism of the head portion 14 may be omitted. Furthermore, a transfer mechanism for enabling transfer in the X axis dimension may be provided on the table 6, and alternately the X axis dimension transfer mechanism of the head portion 14 may be omitted. Thus the relative position between the head portion 14 and the two dimensions of the cassette lay-out boards 10A, 10B may be freely taken by allowing the table 6 to travel along the X axis, while the head portion 14 is allowed to travel along the Y axis. Moreover, the wire clamping function of the wire drawing mechanism 12 may be utilized instead of the wire pressing mechanism 36A, and thus the latter may be omitted.

Figure 7A:
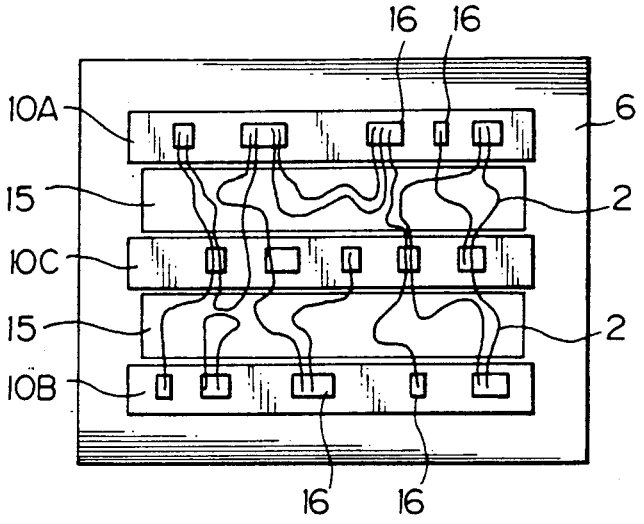
FIGS. 7(A), (B) and (C) are plan views of cassette lay-out boards according to the other embodiments of the present invention.
Figure 7B:
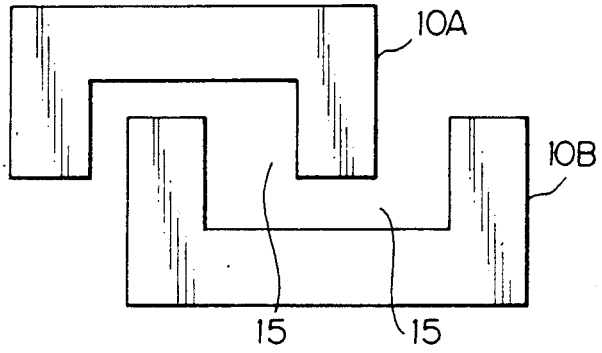
Figure 7C:
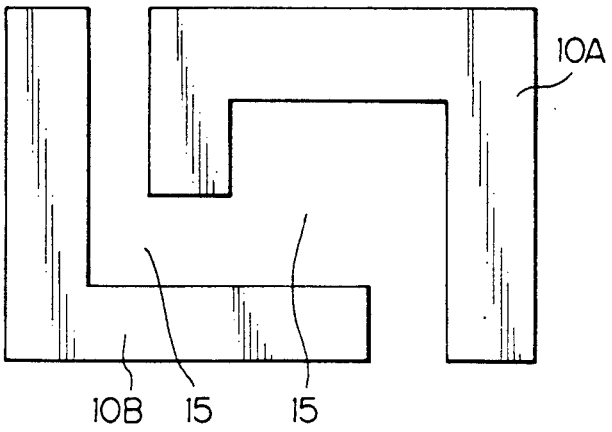

Furthermore, as shown in FIG. 7, a cassette lay-out board 10C on which intermediate connectors 16 to which the intermediate portions of the wires are press-connected are arranged may be provided between the cassette lay-out boards 10A, 10B, and depressions 15 may be provided, respectively, between the cassette lay-out boards 10A and 10C and between the cassette lay-out boards 10C and 10B. Thus, the construction in which the three cassette lay-out boards are used may be adopted. Alternatively, as shown in the same drawing, non-symmetrical cassette lay-out boards 10A, 10B may be utilized.

Figure 8A:
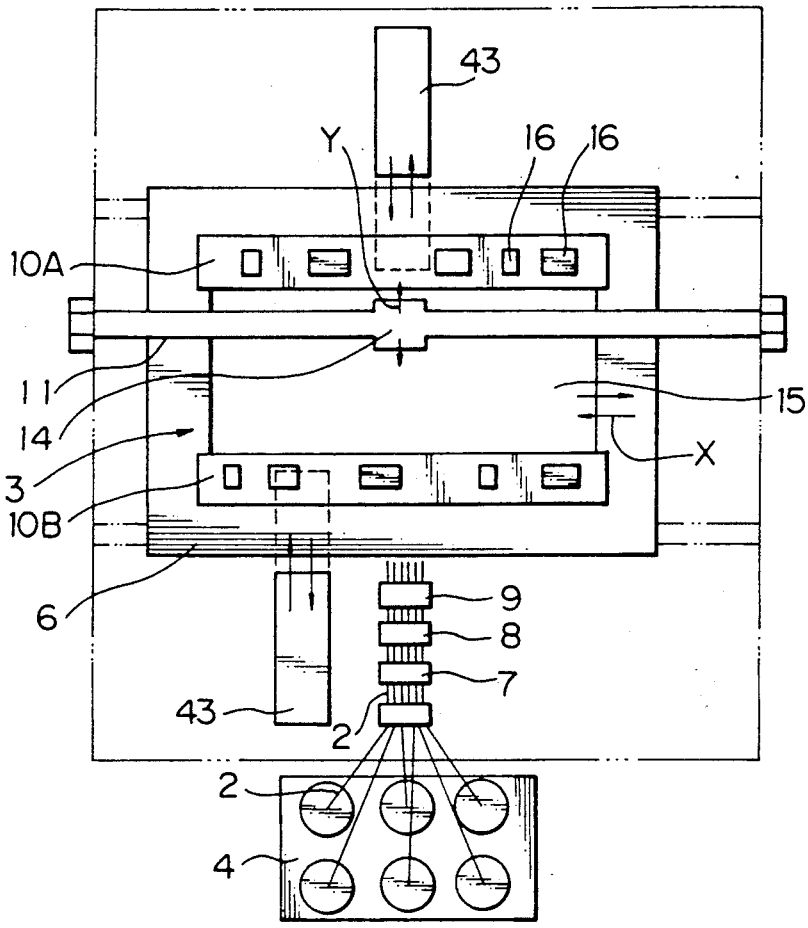
FIG. 8(A) is a plan view showing the whole of the apparatus.

Referring to FIG. 8, the second embodiment of the present invention will now be described. In this second embodiment, the wire press-connecting mechanism 13 of the head portion 14 utilized in the first embodiment is omitted. Instead, independent press-connecting presses 43 are provided at positions adjacent to the outer edges of the cassette lay-out boards 10A, 10B, and a transfer mechanism for enabling transfer along the X axis is provided on the table 6. The head portion 14 is provided at the laterally central position of the travelling portal frame 11 adapted to travel along the sides of the frame 5 in such a manner as to vertically suspend therefrom, and the direction in which it is disposed is fixed.

Figure 8B:
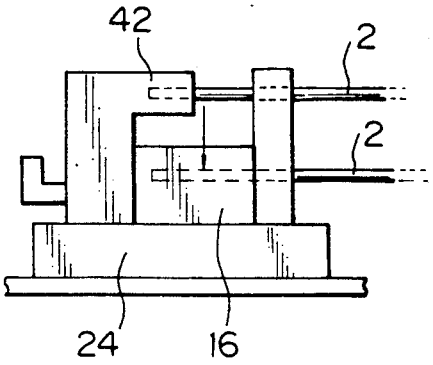
FIG. 8(B) is a front view of the connector fixing jig employed therein.
Figure 2A:
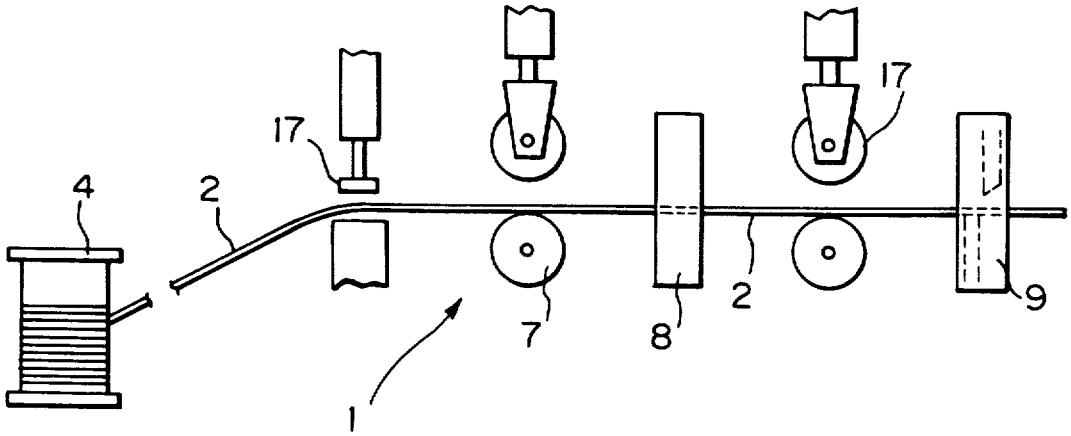
Figure 2B:
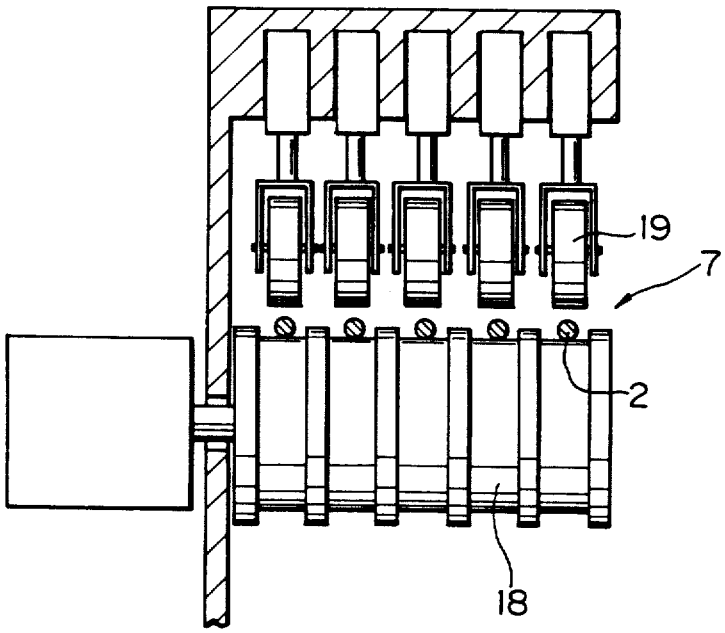

A slide mechanism for enabling transfer along the Y axis is provided on the press-connecting press 43 so as to allow the press to move towards and/or away from the cassette lay-out boards 10A, 10B, and a wire holder 42 is provided on the connector fixing jig 24. This wire holder 42 may be formed for instance as shown in FIG. 8(B), such that the wire is temporarily held in the slot portion formed therein. The wire feed portion 1 cassette lay-out boards 10A, 10B and the depression 15 are the same as those utilized in the first embodiment and the head portion 14 is also provided with the same wire drawing mechanism 12 and wire pressing mechanism 36A as those utilized in the first embodiment.

When the head portion 14 and the table 6 are moved relative to each other the wires 2 fed from the wire feed portion 1 are sequentially distributed to the wire holders 42 on the connectors 16 arranged on the cassette lay-out boards 10A, 10B so as to be temporarily held in position, and the wires are thus laid out. The connectors 16 to which the wires are so held are then sequentially brought in front of the press-connecting press 43 by moving the table 6 along the X axis, and the wires 2 temporarily held on the wire holders 42 are then sequentially press-connected to the connectors 16 by the press-connecting press 43 when it is moved forward.

The wire press-connecting and laying out apparatus according to this embodiment, which is shown in FIG. 8, has also the connectors 16 on the cassette lay-out boards 10A, 10B that are disposed within a short distance in such a manner as to be opposite to each other via the depression 15, the cassette lay-out boards and the wire dispensing head portion 14 that can freely take any relative position along the two dimensions. Thus, with the second embodiment, a function similar to that of the first embodiment shown in FIG. 1 can also be expected.

As is clear from the above description, with the automatic wire press-connecting and laying out apparatus according to the present invention, the efficiency of the press-connecting and laying out wires can remarkably be improved, and moreover, it is possible to obviate the necessity of enormous space for the laying out of wires. Consequently, the present invention is advantageous in that the productivity of wire harnesses can remarkably be improved.

What is claimed is:

1. An automatic press-connecting and laying out apparatus for a wire harness having a press-connecting and laying out portion, comprising:

a wire feed portion having a wire feeding mechanism adapted to individually feed out a plurality of wires and a severing mechanism for individually severing each of said plurality of wires at a predetermined length;

cassette lay-out boards detachably and horizontally spaced apart with a depression therebetween, each of said boards having a group of connectors detachably arranged at predetermined positions thereon; and a head vertically suspended over said boards and adapted to move along orthogonal X and Y axes of said cassette lay-outs boards and to rotate about a vertical axis perpendicular to said X and Y axes, said head comprising a wire drawing mechanism for individually drawing each of said plurality of wires and a wire press-connecting mechanism comprising a plurality of wire press-connecting portions adapted to individually press connect each of said plurality of wires to said connectors, said wire drawing and wire press-connecting mechanisms facing downwardly;

a wire length metering mechanism for individually measuring said length of each of said plurality individual wires on said wire feeding mechanism or on said wire drawing mechanism;

said head adapted to individually clamp each of said plurality of wires protruding from the distal end of said wire feed portion and sequentially distribute and press connect each of said plurality of wires to said connectors, whereby said wires are laid out in a required configuration with intermediate portions thereof being allowed to depend into said depression.

2. The apparatus of claim 1 wherein said plurality of wire press-connecting portions has a press-connecting blade selection mechanism whereby said press-connecting portions can be selectively actuated.

3. An automatic press-connecting and laying out apparatus for a wire harness having a press-connecting and laying out portion, comprising:

a wire feed portion having a wire feeding mechanism adapted to individually feed out a plurality of wires and a severing mechanism for individually severing each of said plurality of wires at a predetermined length;

cassette lay-out boards detachably and horizontally spaced apart with a depression therebetween, each of said boards having a group of connectors arranged at predetermined positions thereon, and having a travel mechanism for movement;

a head vertically suspended over said boards, said head and said boards movable relative to each other along X and Y axes and rotatable relative to each other about a vertical axis which is perpendicular to said boards, and a wire drawing mechanism for individually drawing wires at the lower portion thereof; and presses adapted to press connect each of sid plurality of wires individually at positions adjacent the outer edges of said boards;

said connectors detachably mounted on connector fixing jigs each having a wire holder for temporarily holding a wire, said head portion clamping said wires protruding from the distal end of said wire feed portion and sequentially distributing said wires to said wire holders, said wires being laid out in a predetermined configuration with intermediate portions thereof received in said depression, and said wires being press-connected to said connectors by means of said presses.

* * * * *

UNITED STATES PATENT AND TRADEMARK OFFICE
CERTIFICATE OF CORRECTION

PATENT NO. : 5,052,449

DATED : October 1, 1991

INVENTOR(S) : Fukuda, et al

It is certified that error appears in the above-identified patent and that said Letters Patent is hereby corrected as shown below:

In the drawings sheet 4 of 11 should be deleted to replaced with sheet 4 of 11 as per attached.

Signed and Sealed this

Twenty-second Day of June, 1993

*Attest:*

Michael K. Kirk

MICHAEL K. KIRK

*Attesting Officer*

*Acting Commissioner of Patents and Trademarks*